US010256040B2

(12) United States Patent
Wright

(10) Patent No.: US 10,256,040 B2
(45) Date of Patent: Apr. 9, 2019

(54) METHOD OF ASSEMBLING A TRANSFORMER

(71) Applicant: ALSTOM TECHNOLOGY LTD, Baden (CH)

(72) Inventor: David Wright, Stafford (GB)

(73) Assignee: General Electric Technology GmbH, Baden (CH)

( * ) Notice: Subject to any disclaimer, the term of this patent is extended or adjusted under 35 U.S.C. 154(b) by 166 days.

(21) Appl. No.: 14/900,086

(22) PCT Filed: Jun. 24, 2014

(86) PCT No.: PCT/EP2014/063308

§ 371 (c)(1),
(2) Date: Dec. 18, 2015

(87) PCT Pub. No.: WO2014/206994

PCT Pub. Date: Dec. 31, 2014

(65) Prior Publication Data

US 2016/0148754 A1 May 26, 2016

(30) Foreign Application Priority Data

Jun. 25, 2013 (EP) ..... 13173642

(51) Int. Cl.
*H01F 7/06* (2006.01)
*H01F 41/10* (2006.01)
(Continued)

(52) U.S. Cl.
CPC ..... *H01F 41/10* (2013.01); *H01F 27/2828* (2013.01); *H01F 27/29* (2013.01); *H01F 27/30* (2013.01)

(58) Field of Classification Search
None
See application file for complete search history.

(56) References Cited

U.S. PATENT DOCUMENTS 1,554,664 A 9/1925 Stevens
3,774,135 A 11/1973 Kashima
5,716,224 A * 2/1998 Masuda ..... H01R 13/4536 439/138

FOREIGN PATENT DOCUMENTS

CN 201178017 Y 1/2009
CN 201667276 U 12/2010
(Continued)

OTHER PUBLICATIONS

English-language machine translation of WO 2012/093055-A1 , Siemens AG [DE] (Jul. 12, 2012).
(Continued)

*Primary Examiner* — Paul D Kim
(74) *Attorney, Agent, or Firm* — Foley & Lardner LLP

(57) ABSTRACT

A method of assembling a transformer/reactor is disclosed comprising the steps of: receiving a first coil having a first coil end conductor; receiving a second coil having a second coil end conductor; mounting the first coil and second coil on respective limbs of a magnetic core; arranging the first coil such that the first conductor projects outwardly from the first coil from a point between the first and second coils; arranging the second coil such that the second conductor projects outwardly from the second coil from a point between the first and second coils; and connecting the conductors to form an interconnection between the coils.

10 Claims, 9 Drawing Sheets

(51) Int. Cl.

| | |
|---|---|
| ***H01F 27/28*** | (2006.01) |
| ***H01F 27/30*** | (2006.01) |
| ***H01F 27/29*** | (2006.01) |

(56) References Cited

FOREIGN PATENT DOCUMENTS

| | | | |
|---|---|---|---|
| CN | 102592793 | A | 7/2012 |
| WO | WO-2012/093055 | A1 | 7/2012 |

OTHER PUBLICATIONS

International Search Report and Written Opinion, PCT/EP2014/063308, Alstom Technology Ltd, 10 pages (Sep. 24, 2014).
Machine Translation and Copy of First Office Action and Search issued in connection with corresponding CN Application No. 201410289677.1 dated Mar. 1, 2017.
Machine Translation and Copy of Second Office Action issued in connection with corresponding CN Application No. 201410289677.1 dated Jul. 19, 2017.

* cited by examiner

METHOD OF ASSEMBLING A TRANSFORMER

CROSS REFERENCE TO RELATED APPLICATIONS

The present application is a National Stage of International Application No. PCT/EP2014/063308, filed Jun. 24, 2014, which claims priority to European Application No. 13173642, filed Jun. 25, 2013, which is incorporated herein by reference in its entirety.

This invention relates to a method of assembling a transformer and, more particularly, to a method of connecting the windings on coils mounted on different limbs in a high voltage transformer, such as an ultra high voltage alternating current (UHVAC) reactor or an ultra high voltage direct current (UHVDC) transformer. The invention also relates to a kit of parts for forming a connection between windings on limbs of a high voltage transformer.

A typical UHVDC or UHVAC transformer has windings that are distributed over more than one limb of a magnetic core. The magnetic core typically has two, three or more interconnected limbs that are each adapted to receive a coil. The coils are connected together, in series or parallel, to form the transformer windings. Each limb and its associated coil are required to be insulated as are the interconnections between the coils. The coils and interconnections between the coils must be suitably sized and rated for the voltage they are expected to carry but must also be compact.

Transformers are known that include interconnections between the coils that extend from the top or bottom of the coils, i.e. from an axial end of the coils. These arrangements can affect the transformer's ability to manage short circuit forces. Other arrangements require the use of an external cleat bar chamber or a wider tank, which increase costs and manufacturing problems. FIG. 1*c* shows a prior design having an external cleat bar chamber 9 that extends from a tank 11, which contains the windings. The cleat bar chamber increases the width of the transformer.

The overall size of a UHVDC or UHVAC transformer, and in particular the width, is an important consideration in terms ensuring the transformer can be transported easily. It is convenient if the assembled transformer can fit within standard size international shipping containers, for example. To achieve the maximum ratings, it is common for the coils of the transformer to approach the width of a shipping container. Therefore, it is advantageous if the interconnections between the coils do not greatly or do not at all increase the width of the transformer.

According to a first invention of the invention, we provide a method of assembling a transformer/reactor comprising the steps of;

- receiving a first coil having a first coil end conductor;
- receiving a second coil having a second coil end conductor;
- mounting the first coil and second coil on respective limbs of a magnetic core;
- arranging the first cod such that the first conductor projects outwardly from the first coil from a point between the first and second coils;
- arranging the second coil such that the second conductor projects outwardly from the second coil from a point between the first and second coils; and
- connecting the conductors to form an interconnection between the coils.

This is advantageous as the ends of the windings of the first and second coil can be arranged such that they can be connected together easily while remaining with a bounding box that surrounds the first and second coils. With the first coil and second coil mounted side by side, the first coil end conductor can be connected to the second coil end conductor within the width of the coils, which is advantageous.

The first and second conductors may project from the coils at first and second projection points respectively, wherein the first coil end projection point and second coil end projection point are spaced inwardly of a plane that lies along an axial side of the first and second coils.

The method may include the step of arranging the interconnection such that it extends outwardly from the projection points towards the plane. The interconnection may be arranged to extend substantially wholly within a gap between the coils. The method may include the step of forming an arcuate interconnection or an interconnection that includes a bend therein. This is advantageous as the interconnection is formed within the width of the coils and may not extend past the plane. The fact that it extends outwardly from the projection points and bends or arcs allows the connection between the conductors to be made easily.

The first coil end conductor and second coil end conductor may be arranged to project outwardly in a substantially radial direction from the first coil and second coil respectively.

The method may include the steps of;

- mounting a first conducting tube around the first coil end conductor; and
- prior to mounting the second coil in its final position on its limb of the magnetic core in which the coil end conductors are aligned, mounting a second conducting tube around the second coil end conductor.

The method may further include the steps of;

- mounting two or more insulation rings within one another over the conducting tubes within a snout of the respective coil.

This is advantageous as the insulation rings can be mounted on the first and second conducting tubes for moving to their final position once the conductors and conducting tubes are connected together and the insulation is built up around the assembly.

Preferably, the method includes the step of moving the second coil to its final position in which the coil end conductors are aligned, the first and second conducting tubes configured and arranged to provide an access gap therebetween to provide access to the coil end conductors.

This is advantageous as the conductors and conducting tubes are configured and arranged to allow the coil end conductors to project from the ends of the conducting tubes. Thus, the coil end conductors can be connected together, and insulated, in the gap between the first and second conducting tubes.

The method may include the step of bridging the gap between the first conducting tube and the second conducting tube with a bridging tube.

Preferably, the first and second conducting tubes are insulated prior to mounting on the first and second coils. Preferably the first and second conducting tubes are arcuate to compliment the interconnection. Alternatively or in addition, the bend of the interconnection may be provided by the bridging tube.

Each coil may be insulated and include a snout at the coil end projection point.

The method may include the step of applying insulation around the first and second conducting tubes and the bridging tube.

The method may include the step of sliding the insulation rings from the respective snouts over the first and second conducting and bridging tube and applying further insulation over the insulation rings. This is advantageous as the insulation rings provide a pre-installed means to space the layers of insulation.

Preferably the step of applying insulation includes mounting pre-moulded insulation pieces around the first and second conducting and bridging tube and securing the pieces together. The pre-moulded insulation pieces may be arcuate or include a bend.

According to a further aspect of the invention, we provide a kit of parts for use in assembling a transformer/reactor, as defined in the first aspect of the invention.

According to a further aspect of the invention, we provide a transformer/reactor comprising a first coil and second coil mounted on respective limbs of a magnetic core, the coil end conductor of the first coil and coil end conductor of the second coil connected together by an interconnection, wherein the first coil conductor extends from the first coil at a point between the first and second coil and the second first coil conductor extends from the second coil at a point between the first and second coil.

There now follows, by way of example only, a detailed description of the invention with reference to the accompanying drawings in which;

FIG. 1*a* shows an assembled transformer/reactor assembled using an exemplary embodiment of the method of the invention;

FIG. 1*b* shows a simplified plan view of the assembled transformer/reactor of FIG. 1;

FIG. 1*c* shows a known transformer having an external cleat bar chamber;

FIGS. 2-31 show an example of the steps performed in assembling the transformer/reactor and, in particular, forming a connection between two coils; and FIG. 32 shows a flow chart illustrating an embodiment of the method of the invention The size of the transformer is related to its power rating and therefore higher rated transformers tend to be larger in size. The transportation of higher rated transformers is a problem as it is difficult for them to fit inside standard size shipping containers. It is the width of the transformer that is most constrained by this requirement. Multi-limb transformers, in which windings of the transformer are distributed over several limbs of a magnetic core allow the width of the transformer to be reduced but the interconnections between the windings on each limb also need to be compact if the transformer is to fit within a shipping container.

FIG. 1 shows a transformer/reactor 1 with windings split into two coils, first coil 2 and second coil 3, for distribution over two limbs (obscured by the coils) of a magnetic core 4.

A limb comprises a projection from the core 4 that extend through the centre of the coil 2, 3. The end of the windings on the first coil 3 are connected to the end of the windings on the second coil 4 and then insulated to form an interconnection 5. A second interconnection 6 is shown in FIG. 1. The coil interconnections are formed between sides of the substantially cylindrical coils rather than between ends.

The coil interconnection 5 projects from the first coil 2 at a first coil end projection point 7 and from the second coil 3 at a second coil end projection point 8. The coil interconnection 5 is arcuate in this embodiment, although it could include one or more bends such that it can extend outwardly from one coil and back inwardly to the meet the other coil. The interconnection extends in a direction outwardly from between the coils. The interconnection, while extending outwardly, may not extend beyond the gap between the coils, i.e. beyond the width of the coils.

FIG. 1*b* shows a simplified plan view of the transformer/reactor 1 shown in FIG. 1. Dashed line 10 represents a plane that lies along the sides of the first and second coils 2, 3. The plane would define a side of an imaginary bounding box (shown in dashed lines) that surrounds the first and second coils 2, 3. The first coil end projection point 7 and second coil end projection point 8 are spaced inwardly from the plane 10 and the arcuate interconnection extends towards the plane but, in this embodiment, does not extend through it. This is advantageous as the interconnection 5 lies within the width of the coils 2, 3 themselves and therefore ensures the interconnection does not increase the overall width of the transformer/reactor 1, which could stop the transformer/reactor 1 being transported in a standard size shipping container, such as a railway shipping container. However, the outwardly extending interconnection provides the space for access to the windings to form an electrical connection between the coils and to subsequently insulate the interconnection as will be discussed below.

FIGS. 2 to 31 show an example of the steps to assemble the coils 2, 3 onto the core 4 and form the interconnection 5.

FIG. 2 shows a strand 20 of a first coil end conductor of the first coil 2. Several strands 20 may form the first coil end conductor. A connector crimp 21 is added to the end of each strand 20. The connector crimp 21 is crimped around the strand to secure it thereto. The connector crimp 21 includes a hole 22 for receiving a bolt, which is used to connect the crimp to a crimp on the second coil end conductor. The strands 20 are insulated up to the connector crimp 21. A potential lead 23 is connected to one of the strands for connected to a conducting tube discussed below.

FIG. 3 shows the first coil 2 mounted on its respective limb and the mounting of a first conducting tube 32 over the first coil end conductor 30. In particular, the first coil 2 has been insulated and an aperture has been formed in the insulation to allow the first coil end conductor 30 (formed of several strands having connector crimps connected thereto) to project out of the insulation. A snout 31 is formed around the aperture comprising a support structure and layers of insulation. The first conducting tube 32 is placed over the first coil end conductor 30 and engaged with the snout 31. The first conducting tube 32 is sized to allow the first coil end conductor 30 to project from its free end. Further, the first conducting tube 32 is arcuate and its external surface is partially insulated.

FIG. 3 also shows the mounting of several insulation tubes 33 (also known as concentric barriers) that slot inside one another over the first conducting tube 32. The insulation tubes 33 are mounted within the snout 31 and provide a spacing and supporting function for further parts of the insulation assembly as well as acting as part of the insulation assembly themselves. The insulation tubes 33 are typically approximately 150 mm long, although it will be appreciated that other sizes are possible.

FIGS. 4 and 5 show the second coil 4 mounted on its respective limb but not resting in its final position. The second coil is spaced from its final position such that the first coil end conductor 30 is not aligned end-to-end with the second coil end conductor 40. However, the conductors 30, 40 are aligned in an axial direction with respect to the coils 2, 3. This allows the length of the second coil end conductor 40 to be adjusted so that when the second coil 3 is lowered to its final position, the conductors 30, 40 will be of the correct length to connect together. Thus, the strands that make up the second coil end conductor 40 are cut to length and connector crimps 41 added to each strand (as shown in FIG. 4). The strands that make up the second coil end conductor 40 are insulated up to the connector crimps 41. Stress shields comprising shaped electrodes are positioned at the ends of the windings to improve the electrical stress. The stress shields are connected to the winding end by the potential leads 23.

The second conducting tube 60 is inserted into a snout 61 on the second coil 3 while it is in its spaced position. Also, several insulation tubes 62 that slot inside one another are mounted over the second conducting tube 60. The insulation tubes 62 are mounted within the snout 61 and provide a spacing and supporting function for further parts of the insulation assembly as well as acting as part of the insulation assembly themselves. The second coil 4 is then moved to its final position in which the first and second coil end conductors 30, 40 are end to end.

FIG. 6 illustrates why the second conducting tube 60 is installed over the second coil end conductor 40 while the second coil 4 is spaced from alignment with the first coil 3 in an axial direction. As can be seen, the second conducting tube 60 can not be slotted into the snout 61 when the first and second coils are in the final position shown in FIG. 6.

FIG. 7 shows a loop of cotton tape 70 fitted around one of the insulation tubes 33, 62 in two places. This is used to help move the insulation tubes from inside the snouts 31, 61 into the correct position during assembly. Once each insulation tube is in the correct position the tape 70 must be removed.

FIG. 8 shows the first coil end conductor 20 and second coil end conductor 40 being connected together by bolts that extend through the holes 22 in the crimp connectors 21, 41. The crimp connectors are now insulated. The potential lead, mention above in the description of FIG. 2, is connected to a connector 90 on one of the first and second conducting tubes 32, 60. FIG. 9 shows the connector 90 which, in this embodiment, extends from the inside surface of the first conducting tube 32.

FIG. 10 shows the bridging of the gap between the first and second conducting tubes 32, 60 with a conducting bridging tube 100. The bridging tube 100 comprises two halves 100*a* and 100*b*. It will be seen in FIG. 8 that the ends of the first and second conducting tubes 32, 60 were left un-insulated so that the bridging tube 100 can make an electrical connection with the tubes 32, 60. Screws 101 are used to secure the bridging tube 100 to the tubes 32, 60. The screws are countersunk and are flush with the bridging tube 100.

FIG. 11 shows the first and second conducting tubes 32, 60 and bridging tube 100 wrapped with insulation comprising crepe paper 1100, for example, between the snouts 31, 61. The crepe paper is secured using adhesive at its free end.

FIG. 12 shows a pressboard barrier 1200 applied at opposed ends of the crepe paper insulation 1100 (only one end visible in FIG. 12). The pressboard barrier 1200 is of 0.8 mm thick by 50 mm wide pressboard and is arranged to overlap with the paper insulation 1100 by approximately 25 mm.

FIG. 13 shows two bands 1300, 1301 of paper secured at spaced locations on the interconnection 5. The bands are approximately 1 mm thick and are each spaced from the insulation 1100 by three pairs of pressboard strips 1302-1307. The pressboards strips are placed in the top (1302 and 1305), front (1303 and 1306) and bottom (1304, 1307) of the interconnection. This is because the paper tape 1100 applied in the previous step will have a greater thickness at the back as this is the inside of the bend of the arcuate interconnection. The bands 1300, 1301 are used to space further insulation to create an oil gap between the paper tape 1100 and the further insulation.

FIG. 14 shows the further insulation applied in the form of an angled barrier 1400. The angled barrier is pre-moulded in two halves and sits on the bands 1300, 1301 and is secured in place with two bands 1401, 1402 of paper tape. The angled barrier 1400, in this embodiment, is of moulded pressboard and it forms part of the concentric insulation structure around the interconnection.

FIG. 15 shows application of corrugated pressboard rings 1500 at each end of the interconnection 5. FIGS. 15 to 17 show the positioning of insulation tubes 33, 62. In, particular, a first pair of the insulation tubes or "concentric barriers" are moved into position over the conducting tubes 32, 60. FIG. 15 shows a concentric barrier that is placed over (and therefore obscures) a corrugated pressboard ring corresponding to corrugated pressboard ring 1500. The concentric barrier shown in FIG. 15 comprises the second concentric barrier 1501 as it is on the side of the second coil 4. The second concentric barrier 1501 is slid out from the snout 61. The barrier 1501 is secured in place with paper tape around the barrier. It is also secured with tape that extends around the barrier 1501 and onto the angled barrier 1400.

The girth of the second concentric barrier 1501 is required to be within a predetermined range. The pressboard rings 1500 can be reduced in thickness or built up with tape to ensure the barrier 1501 has the correct girth.

FIG. 17 shows the first concentric barrier 1701 moved into position and secured just like the second barrier 1501 described above.

FIG. 18 shows the formation of oil flow holes 1800 through the tape applied in the previous figures that bridges the first concentric barrier 1701 and the angled barrier 1400. Oil flow holes 1800 are also applied through the tape that bridges the second concentric barrier 1501 and the angled barrier 1400. The oil flow holes 1800 may be approximately 10 mm in diameter and equally spaced around each concentric barrier 1501, 1701. The holes allow for oil flow.

FIGS. 19 and 20 show the installation of a second angled barrier 1900. The second angled barrier 1900 is pre-moulded in two halves (one half shown in FIG. 19) and sits on the concentric barriers 1701, 1501 and is secured in place with two bands 2001, 2002 of paper tape.

FIGS. 21 and 22 show a condensed version of the installation process shown in FIGS. 15 to 17. In FIG. 17 corrugated pressboard rings are applied at each end of the interconnection 5. A second pair of concentric barriers 2100, 2101 are placed over the rings. The second pair of concentric barriers are slid out of the snouts. A third angled barrier 2200 is fitted over the second pair of concentric barriers 2100, 2101.

FIG. 27 shows a detailed view of FIG. 26.

Figure 1B:
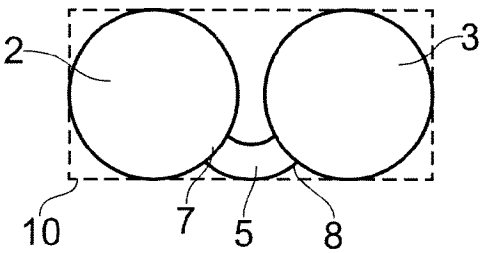
Figure 1C:
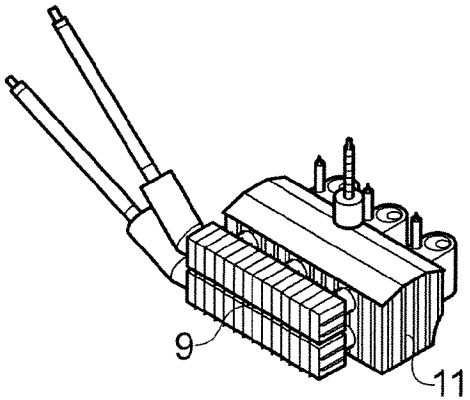
Figure 1A:
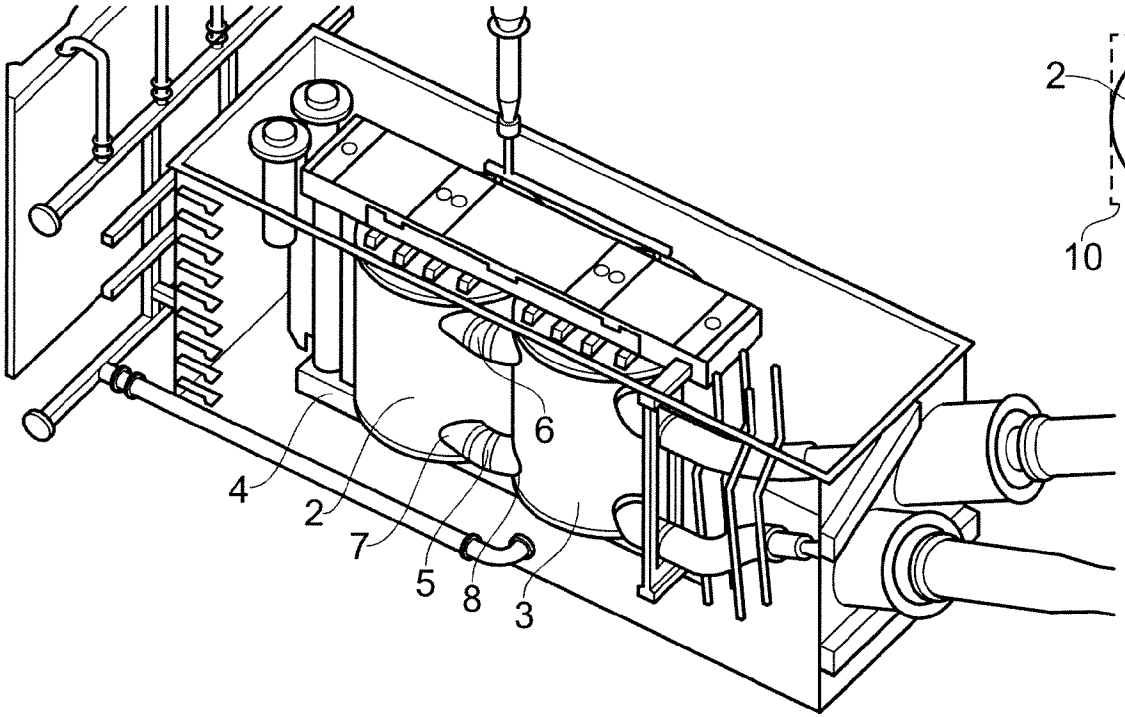
Figure 2:
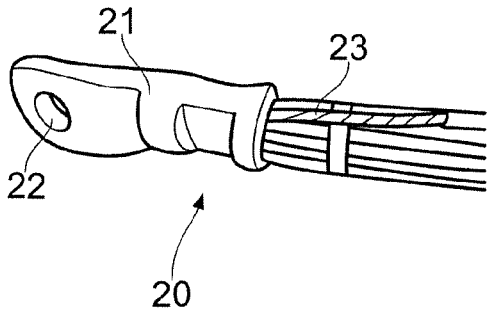
Figure 3:
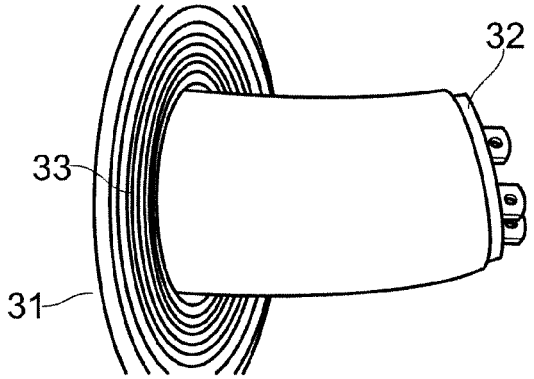
Figure 4:
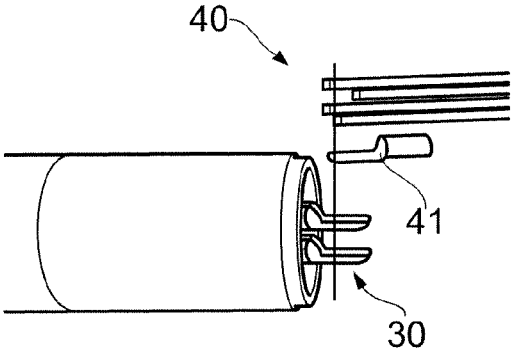
Figure 5:
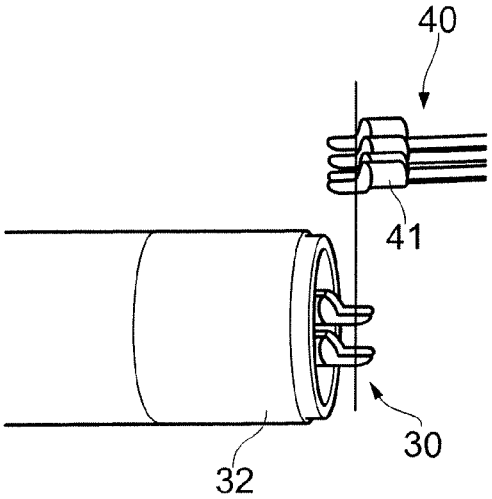
Figure 6:
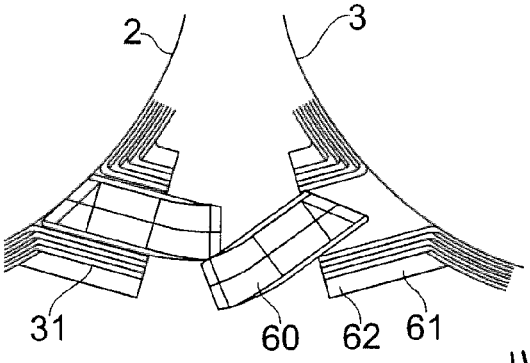
Figure 7:
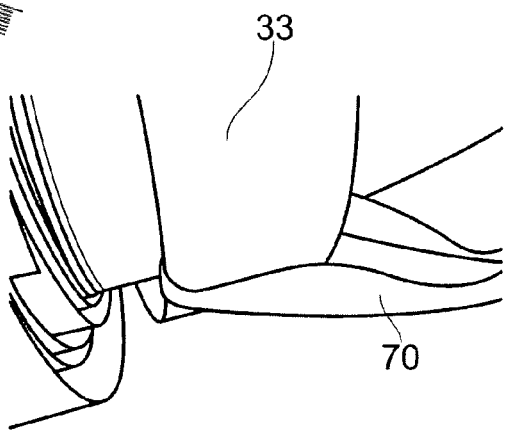
Figure 8:
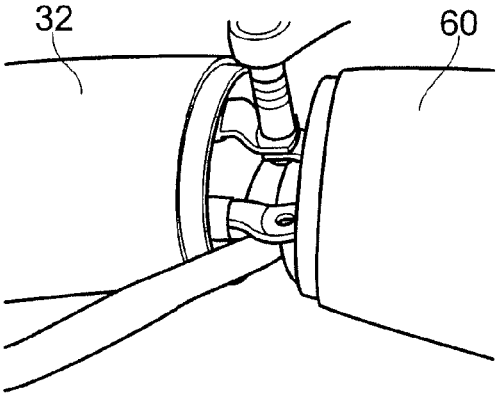
Figure 9:
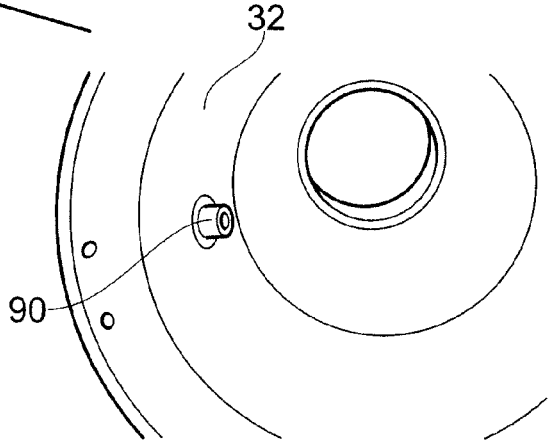
Figure 10:
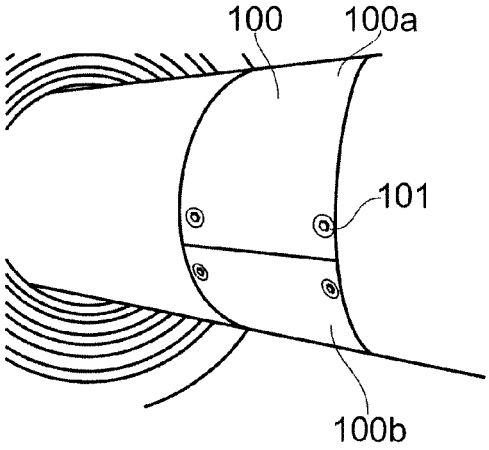
Figure 11:
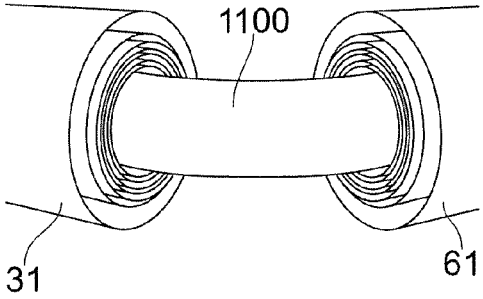
Figure 12:
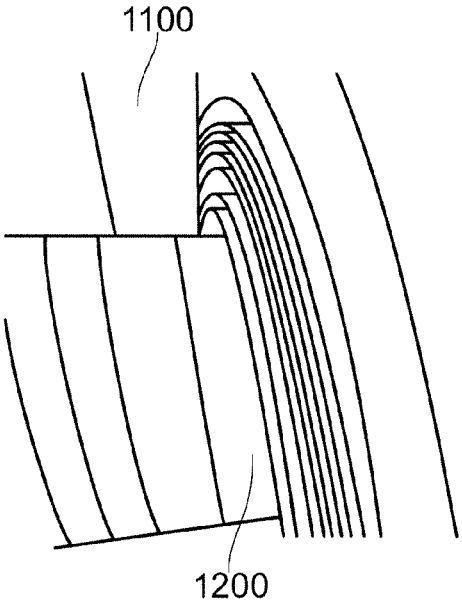
Figure 13:
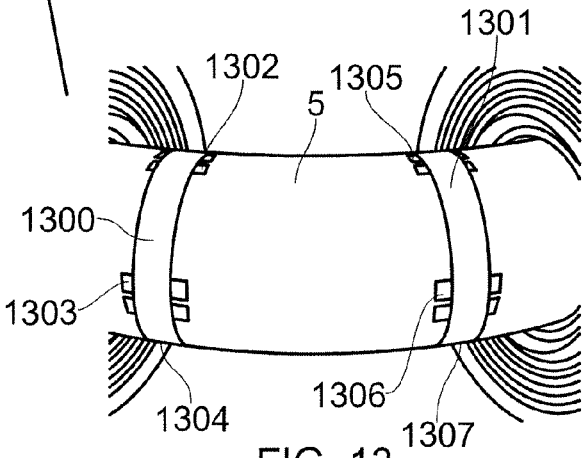
Figure 14:
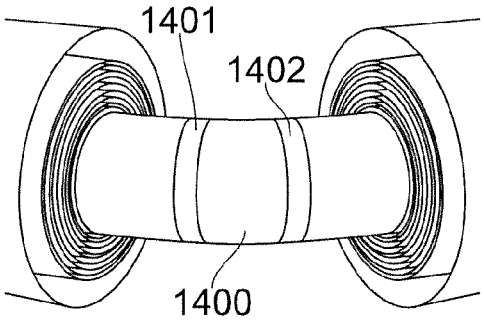
Figure 15:
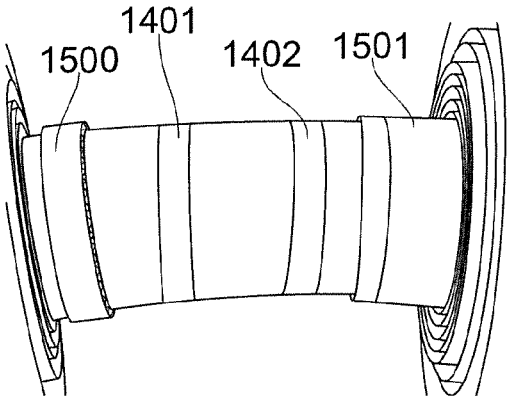
Figure 16:
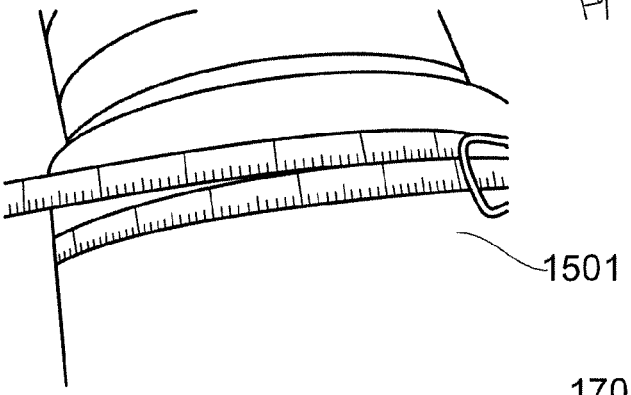
Figure 17:
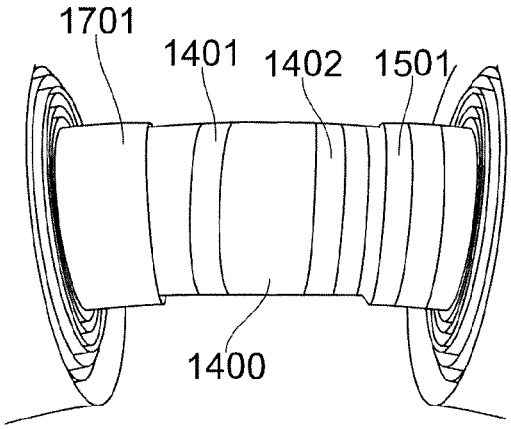
Figure 18:
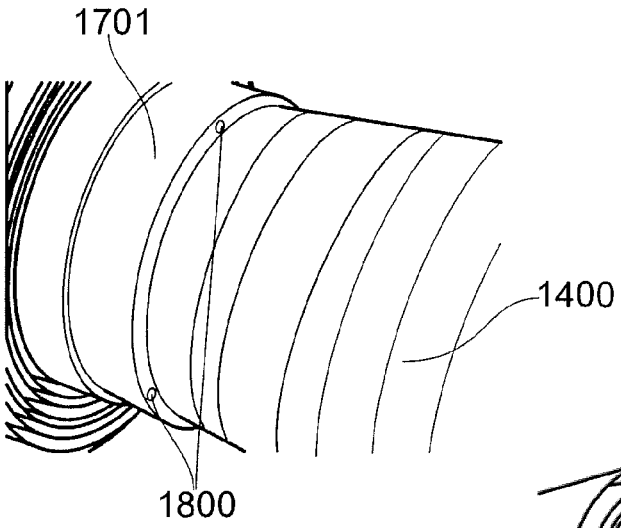
Figure 19:
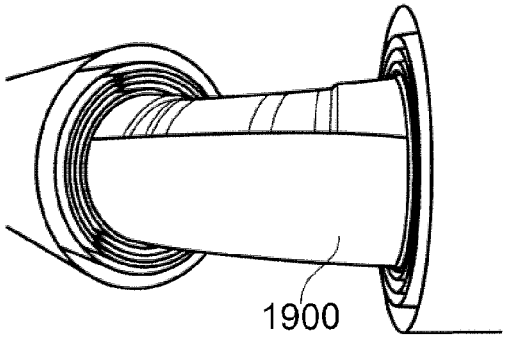
Figure 20:
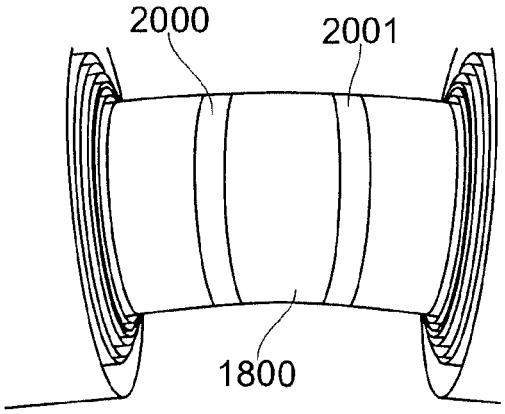
Figure 21:
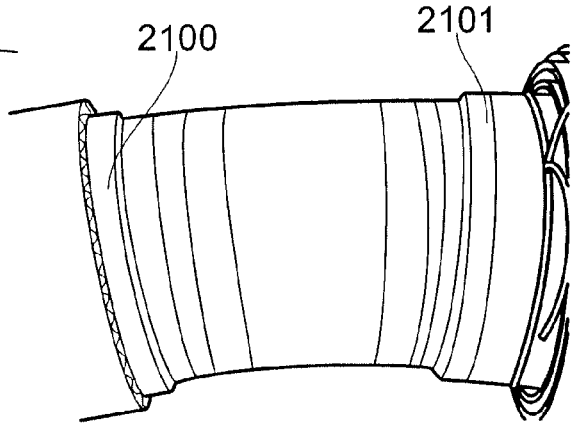
Figure 22:
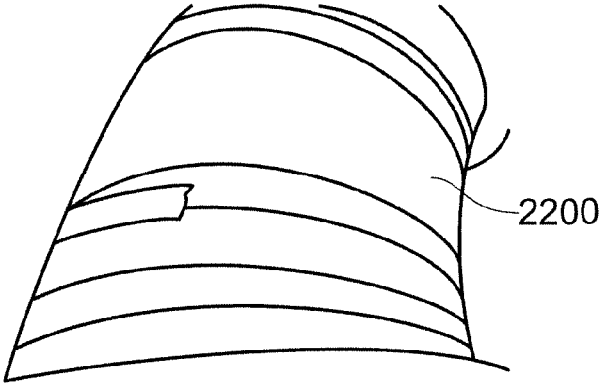
Figure 23:
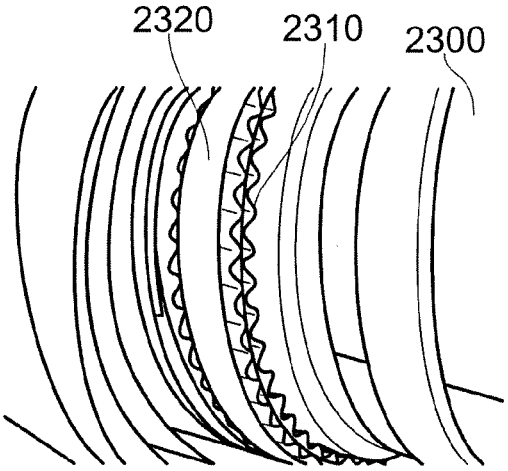
FIG. 23 shows the installation of a third set of concentric barriers with associated pressboard rings and a fourth angled barrier 2300. A fourth set of concentric barriers 2310 and a fifth set of concentric barriers 2320 are positioned and secured without an angled barrier therebetween.
Figure 24:
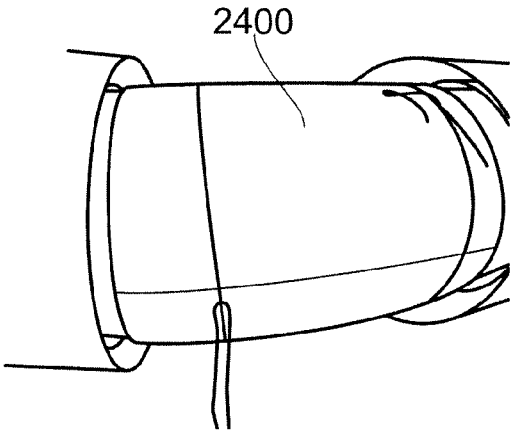
FIG. 24 shows the installation of a fifth angled barrier 2400 that is mounted over the fifth set of concentric barriers. The fifth angled barrier 2400 is secured with two bands of paper tape.
Figure 25:
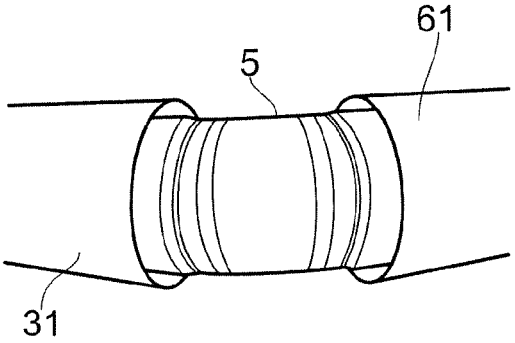
FIG. 25 shows the interconnection 5 almost built up to the thickness of the snouts 31, 61.
Figure 26:
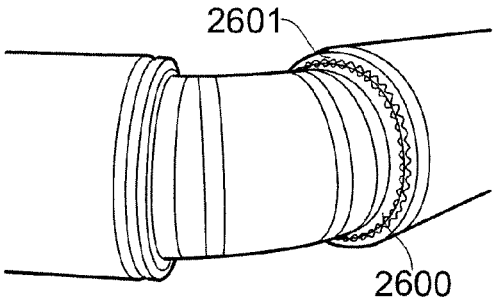
FIG. 26 and FIG. 27 shows the installation of a sixth set of concentric barriers 2600 with the associated pressboard rings 2601.
Figure 27:
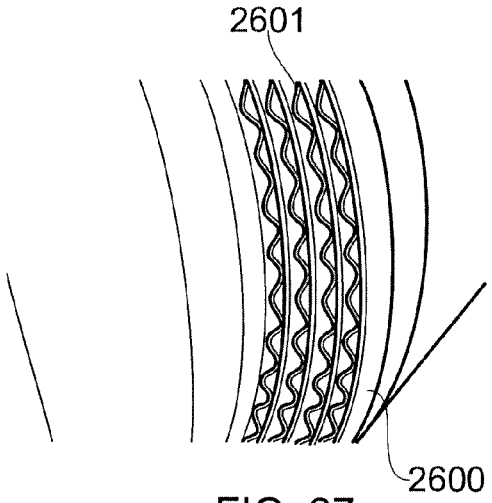
Figure 28:
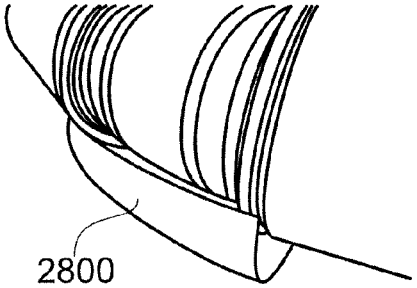
FIG. 28 shows the addition of a sixth angled barrier 2800 that is mounted onto the sixth set of concentric barriers 2600 and secured in place by bands of tape.
Figure 29:
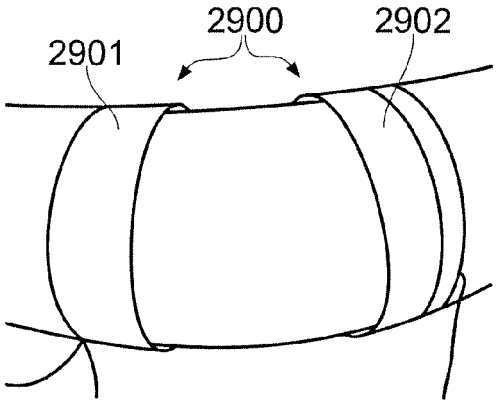

FIG. 29 shows the installation of a seventh set of concentric barriers 2900 with the associated pressboard rings (hidden from view). The seventh set of concentric barriers 2900 comprise a first barrier 2901 and a second barrier 2902. The first and second barriers 2901, 2902 are each formed in two halves. The first barrier 2901 extends between the interconnection 5 and the snout 31. The second barrier 2902 extends between the interconnection 5 and the snout 61.

Figure 30:
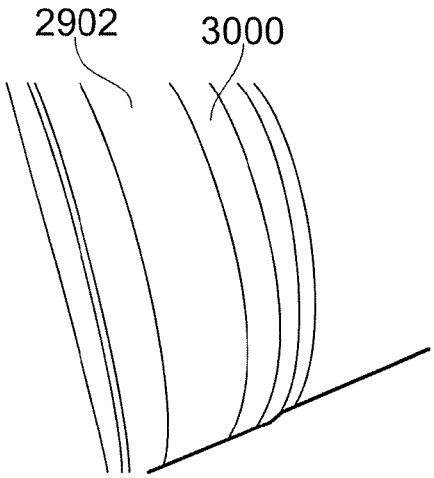
Figure 31:
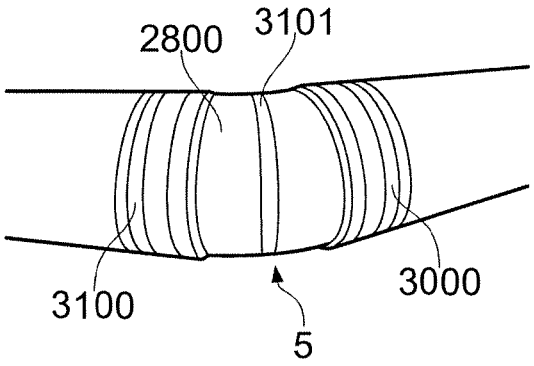

As shown in FIGS. 30 and 31, the first and second barriers 2901, 2902 are secured using tape and webbing 3000 and 3100. The centre of the sixth angled barrier 2800 is also secured with webbing 3101. The webbing is sewn to prevent it coming undone.

The completed interconnection 5 is shown in FIG. 31.

Figure 32:
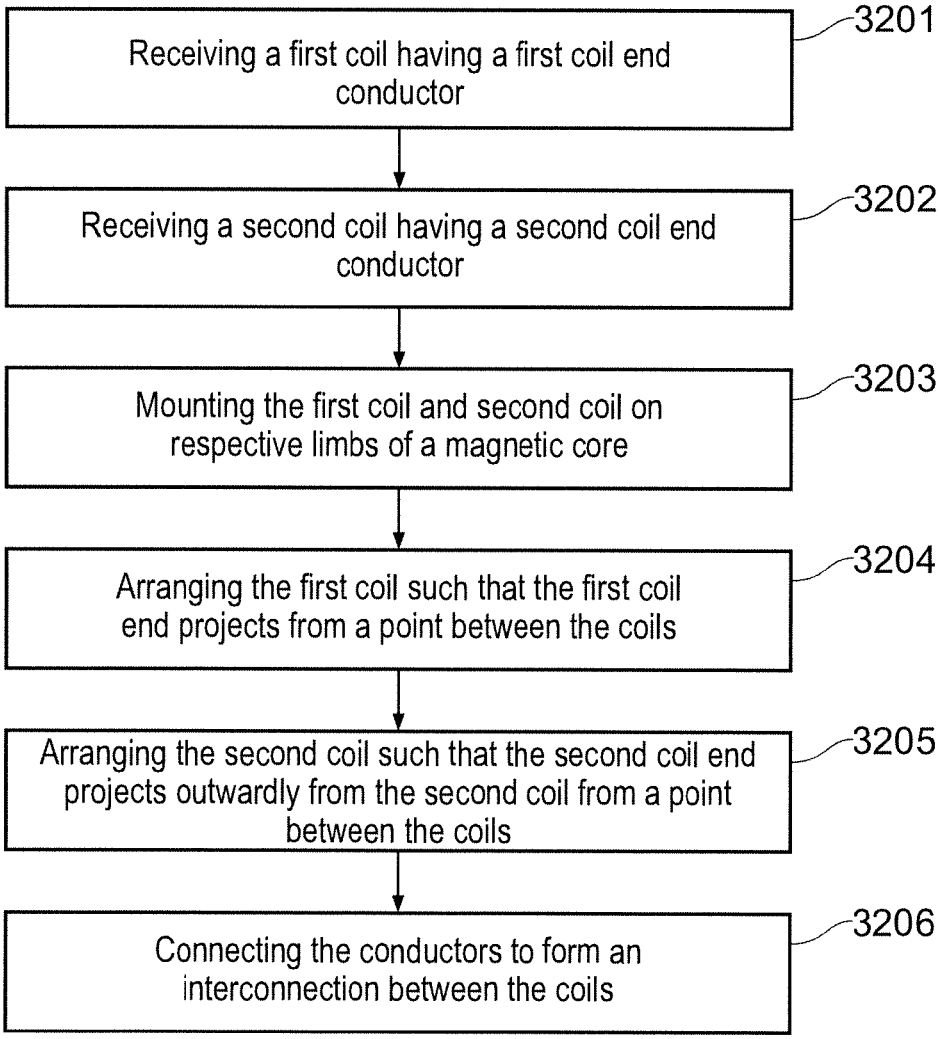

FIG. 32 shows a flow chart illustrating the method of the invention. Step 3201 comprises receiving a first coil having a first coil end conductor. Step 3202 comprises receiving a second coil having a second coil end conductor. Step 3203 comprises mounting the first coil and second coil on respective limbs of a magnetic core. Step 3204 shows arranging the first coil such that the first coil end projects from a point between the coils. Step 3205 shows arranging the second coil such that the second coil end projects outwardly from the second coil from a point between the coils. Step 3206 shows connecting the conductors to form an interconnection between the coils. The first coil end projection point and second coil end projection point can be spaced inwardly of a plane that lies along an axial side of the first and second coils and the interconnection can be arranged to extend outwardly from the projection points while remaining within the gap between the first and second coil.

It will be appreciated that while the interconnection 5 is shown as being arcuate between the projection points 7, 8 it may extend outwardly and have a bend therein. Alternatively, the interconnection may be substantially straight.

The invention claimed is:

1. A method of assembling a transformer/reactor comprising the steps of;

receiving a first coil having a first coil end conductor;

receiving a second coil having a second coil end conductor;

mounting the first coil and second coil on respective limbs of a magnetic core;

arranging the first coil such that the first coil end conductor projects outwardly from the first coil from a point between the first and second coils;

arranging the second coil such that the second coil end conductor projects outwardly from the second coil from a point between the first and second coils;

mounting a first conducting tube around the first coil end conductor;

prior to mounting the second coil in its final position on its limb of the magnetic core, in which the first and the second coil end conductors are aligned, mounting a second conducting tube around the second coil end conductor;

connecting the first coil end conductor and the second coil end conductors to form an interconnection between the coils; and mounting two or more insulation rings over the conducting tubes within a snout of the respective first and second coil.

2. The method of claim 1, wherein the first and second conductors project from the coils at first and second projection points respectively, and wherein the first coil end projection point and second coil end projection point are spaced inwardly of a plane that lies along an axial side of the first and second coils.

3. The method of claim 2, further comprising arranging the interconnection such that it extends outwardly from the projection points towards the plane.

4. The method of claim 1, further comprising forming an arcuate interconnection or forming an interconnection that includes a bend therein.

5. The method of claim 1, further comprising moving the second coil to its final position in which the coil end conductors are aligned, wherein the first and second conducting tubes are configured to have a gap therebetween to provide access to the coil end conductors.

6. The method of claim 5, further comprising bridging the gap between the first conducting tube and the second conducting tube with a bridging tube.

7. The method of claim 6, further comprising applying insulation around the first and the second conducting tubes and the bridging tube.

8. The method of claim 7, in which the step of applying the insulation includes mounting pre-moulded insulation pieces around the first and second conducting tubes and the bridging tube and securing the pieces together.

9. The method of claim 8, wherein the method comprises positioning two or more insulation rings to space apart layers of the pre-moulded insulation pieces.

10. The method of claim 6, further comprising sliding the two or more insulation rings from the respective snouts over the first and second conducting tubes and the bridging tube and applying further insulation over the two or more insulation rings.

* * * * *